US009056658B2

(12) United States Patent
Elmbo

(10) Patent No.: US 9,056,658 B2
(45) **Date of Patent: *Jun. 16, 2015**

(54) ICEBREAKING VESSEL

(75) Inventor: Niels Peter Elmbo, Kokkedal (DK)

(73) Assignee: MAERSK SUPPLY SERVICE A/S, Copenhagen K (DK)

( * ) Notice: Subject to any disclaimer, the term of this patent is extended or adjusted under 35 U.S.C. 154(b) by 258 days.

This patent is subject to a terminal disclaimer.

(21) Appl. No.: 13/077,772

(22) Filed: Mar. 31, 2011

(65) Prior Publication Data

US 2011/0239923 A1 Oct. 6, 2011

Related U.S. Application Data

(60) Provisional application No. 61/319,474, filed on Mar. 31, 2010, provisional application No. 61/409,677, filed on Nov. 3, 2010.

(51) Int. Cl.

| | |
|---|---|
| ***B63B 21/50*** | (2006.01) |
| ***B63B 35/08*** | (2006.01) |
| ***B63B 35/12*** | (2006.01) |
| ***B63H 15/00*** | (2006.01) |

(Continued)

(52) U.S. Cl.

CPC ..... *B63B 35/083* (2013.01); *B63B 35/08* (2013.01); *B63B 35/086* (2013.01); *B63B 35/12* (2013.01); *B63B 21/16* (2013.01); *B63B 21/50* (2013.01); *B63H 15/00* (2013.01); *B63H 25/42* (2013.01)

(58) Field of Classification Search

CPC ..... B63B 21/16; B63B 21/50; B63B 35/08; B63B 35/083; B63B 35/086; B63B 35/10; B63B 35/12; B63H 5/00; B63H 5/08; B63H 2005/1254; B63H 15/00; B63H 25/42; E02B 15/02

USPC ..... 114/40–43, 293, 294; 405/217

See application file for complete search history.

(56) References Cited

U.S. PATENT DOCUMENTS

| | | | | |
|---|---|---|---|---|
| 3,656,449 | A | 4/1972 | Mead | |
| 3,837,311 | A | 9/1974 | Lea, Jr. | |
| 3,872,814 | A * | 3/1975 | Rodriguez | 114/40 |

(Continued)

FOREIGN PATENT DOCUMENTS

| | | | |
|---|---|---|---|
| CA | 1232768 | A | 2/1988 |
| CA | 2684772 | A1 | 11/2008 |

(Continued)

OTHER PUBLICATIONS

Danish office action for PA 2010 70136, Completed Nov. 12, 2010.

(Continued)

*Primary Examiner* — Ajay Vasudeva

(74) *Attorney, Agent, or Firm* — Brinks Gilson & Lione

(57) ABSTRACT

A vessel and method for breaking ice drifting in a predominant direction relative to an offshore installation such as a drilling vessel. The vessel is used to deploy an anchor in a position at a distance from the offshore installation and in a direction which, seen from the offshore installation, is substantially in parallel with the direction of movement of the ice. By means of the machinery of the vessel, the direction of the anchor line is adjusted and so is the orientation of the vessel relative to the anchor line to the effect that the propellers can be used to crush and dispose of the ice without using motive energy to hold the vessel against the pressure of the ice.

27 Claims, 10 Drawing Sheets

(51) Int. Cl.

| | |
|---|---|
| ***B63H 25/42*** | (2006.01) |
| *B63B 21/16* | (2006.01) |

(56) References Cited

U.S. PATENT DOCUMENTS

| | | | | |
|---|---|---|---|---|
| 3,881,318 | A | 5/1975 | Galloway | |
| 3,886,882 | A * | 6/1975 | Thornburg et al. | 114/40 |
| 3,965,835 | A | 6/1976 | Bennett | |
| 4,215,952 | A | 8/1980 | Baardsen | |
| 4,547,093 | A | 10/1985 | Statham | |
| 4,716,972 | A * | 1/1988 | Makinen et al. | 175/8 |
| 4,800,831 | A * | 1/1989 | Hellmann et al. | 114/40 |
| 5,224,800 | A | 7/1993 | Mogridge | |
| 5,676,083 | A * | 10/1997 | Korsgaard | 114/230.1 |
| 7,681,511 | B2 * | 3/2010 | Breivik et al. | 114/40 |
| 8,347,801 | B2 * | 1/2013 | Denise | 114/40 |
| 2003/0131777 | A1 | 7/2003 | Fischer | |
| 2013/0074753 | A1 * | 3/2013 | Elmbo | 114/40 |
| 2013/0087088 | A1 * | 4/2013 | Elmbo | 114/40 |

FOREIGN PATENT DOCUMENTS

| | | | | |
|---|---|---|---|---|
| CN | 201214482 | Y * | 4/2009 | |
| FR | 2924677 | A1 | 6/2009 | |
| GB | 2295372 | A * | 5/1996 | |
| WO | 2007089152 | A1 | 8/2007 | |
| WO | WO 2007089152 | A1 * | 8/2007 | B63B 35/12 |
| WO | 2007136273 | A1 | 11/2007 | |
| WO | 2008116964 | A1 | 10/2008 | |
| WO | WO 2008116964 | A1 * | 10/2008 | B63B 35/08 |
| WO | 2008140654 | A1 | 11/2008 | |
| WO | 2009099337 | A1 | 8/2009 | |
| WO | 2010103170 | A2 | 9/2010 | |

OTHER PUBLICATIONS

Danish office action for PA 2011 70154, Completed Nov. 8, 2011.
Danish office action for PA 2010 70465, Completed Sep. 14, 2011.
International Search Report for PCT/DK2011/050105, mailed Sep. 14, 2011.
International Search Report for PCT/DK2011/50104, mailed Sep. 14, 2011.
Written Opinion for PCT/DK2011/050105, mailed Sep. 14, 2011.
Written Opinion for PCT/DK2011/50104, mailed Sep. 14, 2011.
International Type Search Report, mailed Sep. 20, 2011.
International Preliminary Report on Patentability for PCT/DK2011/050105, mailed Oct. 2, 2012.
International Preliminary Report on Patentability for PCT/DK2011/50104, mailed Oct. 2, 2012.

* cited by examiner

ICEBREAKING VESSEL

RELATED APPLICATIONS

This application claims the benefit of the filing dates of U.S. Provisional Patent Application Ser. No. 61/319,474 filed on Mar. 31, 2010; Danish Application No. PA 2010 70136 filed on Mar. 31, 2010; U.S. Provisional Patent Application Ser. No. 61/409,677 filed on Nov. 3, 2010; Danish Application No. PA 2010 70465 filed on Oct. 29, 2010; and Danish Application No. PA 2011 70154 filed on Mar. 31, 2011. Each of the above mentioned U.S. provisional applications and Danish applications is incorporated in its entirety by reference herein.

BACKGROUND

It is very important that offshore installations in ice-filled waters are protected against the impacts of the ice. For instance, an oil or gas platform may be concerned. Typically, floating ice drifts with the current, but it is also influenced by the wind. The ice may come in large chunks or pieces, or ice floes, which can cause damage to ocean-going vessels and offshore platforms such as a drilling platform or drilling vessel. Further, it is known that coherent ice floes normally have greater strength than ice floes that are broken or partially broken.

In order for a large drilling vessel to operate, it must not be significantly affected or damaged from impact by drifting ice floes. Upon impact, a drilling vessel must usually not be shifted more than about 2% of the depth of the water before the drilling operation has to be discontinued, and, if it is shifted more than about 5%, the drill pipe must usually be disconnected. It is therefore to be understood that impacts from ice, in particular in shallow waters, are extremely critical. Under no circumstances should large pieces of ice be allowed to hit the drilling vessel.

It is known within the prior art to use several, typically three, powerful icebreakers that cooperate to manage ice and ensure that large chunks of ice cannot drift towards the platform or that the ice is not capable of packing around it. These vessels utilize their own motive power.

Pack ice and ridged ice are the types of ice that require the largest amount of energy to avoid. It is assumed that by means of conventional icebreakers it may be necessary to use machine power of upwards of 60-70 Megawatts, when the ice is thick and the current is heavy. That magnitude of machine power is comparable with nuclear-powered vessels, and in view of the fact that three vessels are often used, it will be understood that it is extremely resource-demanding and cost-intensive to secure a drilling vessel against the impacts of the ice.

BRIEF SUMMARY

The object of the invention is to provide a vessel which is considerably more resource-saving than the prior art.

According to one aspect of the invention, a method is provided for the breaking of ice drifting with a predominant direction relative to an offshore installation, such that, by means of a vessel, an anchor is deployed in a position at a distance from the offshore installation and in a direction which is, as seen from the offshore installation, substantially in parallel with the direction of movement of the ice. The machinery of the vessel is used to adjust the direction of the anchor line.

In another aspect of the invention, a method is provided wherein a vessel having one or more azimuth propellers and/or side propellers are used to assist in icebreaking tasks.

In yet another aspect of the invention, winch machinery is used to adjust the direction of the vessel relative to the direction of the anchor line.

In yet another aspect of the invention, the vessel is turned such that the heel is facing towards the ice.

In another aspect of the invention, several anchors are deployed in dissimilar directions relative to the offshore installation.

In yet another aspect of the invention, a plurality of vessels are used and deployed in various anchored positions relative to the offshore installation.

In another aspect of the invention, the opening through which the anchor line travels being located below (deeper than) the propeller shaft or other drive members of the vessel.

According to another aspect of the invention, a number of GPS apparatuses are deployed on the ice, upstream of and at a distance from the offshore installation, so that information received from then GPS apparatuses are used to detect a change in the direction of movement of the ice; and that this information is used to decide whether one or more anchors and vessels are to be moved.

BRIEF DESCRIPTION OF THE DRAWINGS

The invention will now be explained in further detail with reference to a number of embodiments, reference being made to the drawing, wherein.

DETAILED DESCRIPTION OF THE DRAWINGS AND THE PRESENTLY PREFERRED EMBODIMENTS

Figure 1:
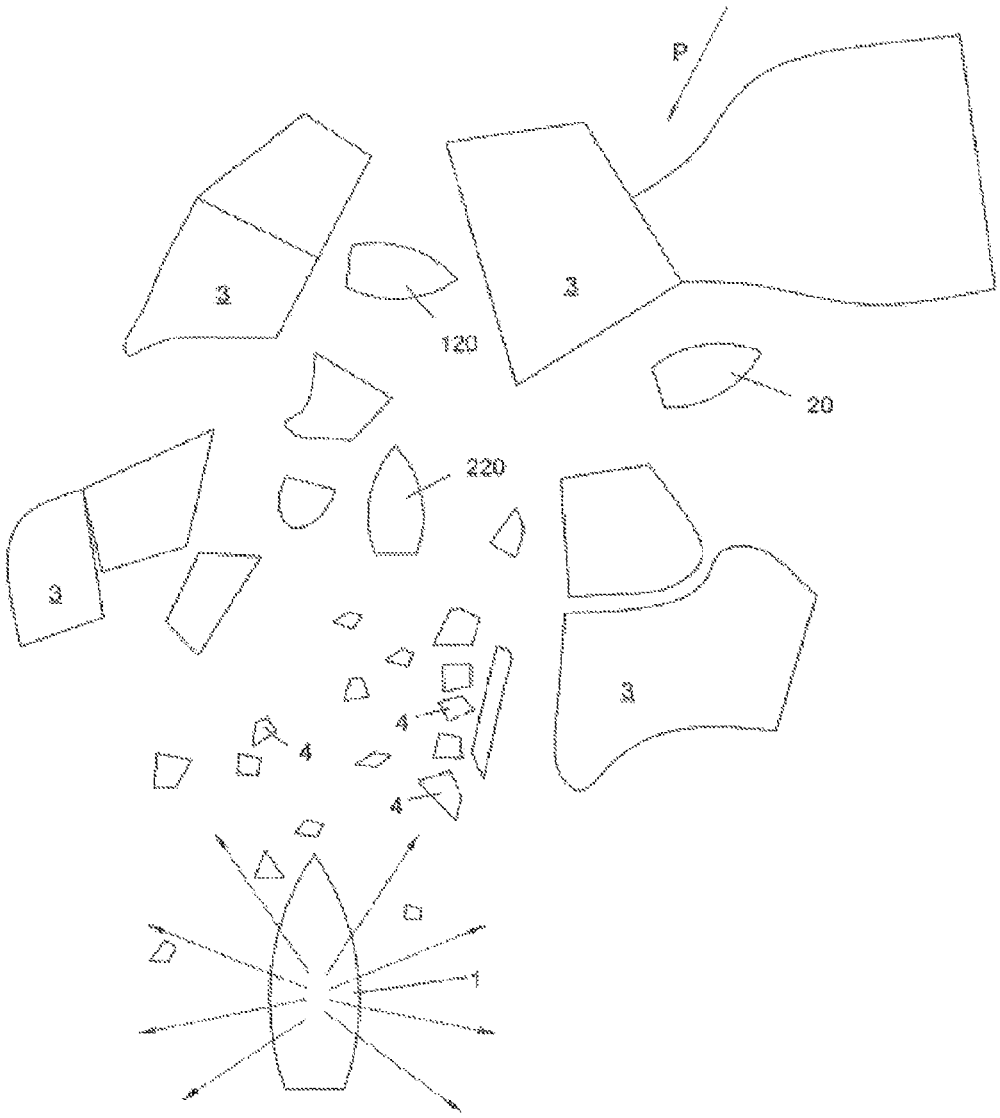
FIG. 1 Prior art
FIG. 1 illustrates the prior art.

Most of the present embodiments below incorporate one or more vessels that include at least a first opening through which an anchor line may pass into the water. This opening is placed on a lower point of the hull of the vessel that is located under (deeper than) the vessel's submerged portion of the propeller shaft and/or propeller. In other embodiments, at least a plurality of openings are provided. As an example, the first opening is located along a longitudinal length of the vessel, such as a centerline, between an approximate midpoint of the vessel and the stern. The other opening is located between this midpoint and the vessel's bow. By providing the vessel with two openings located in these positions or approximate thereto, the vessel may be manipulated and oriented using power of anchor line winches so that it is positioned in the best way relative to flowing ice, such as with the vessel turning its heel, bow or starboard or lateral sides towards the oncoming ice flow.

According to the prior art, one would, when one tethers a vessel to an anchor, secure the anchor line to the vessel at a large distance from the natural pivot point of the vessel. Thereby one hopes that the vessel will—due to the momentum created thereby between point of attachment and pivot point—seek to maintain a fixed orientation relative to the ice/current or wind that influences the vessel.

By positioning the opening in the vessel and there below, the anchor line is furthermore located in closer proximity to the natural pivot point of the vessel, and thereby it is accomplished that the above-referenced momentum is minimized whereby it becomes easier to freely select a suitable orientation of the vessel, while the latter—under the influence of the forces from the anchor—is moved through the ice, transversally to the direction of movement thereof and across the bed of the water under the influence of the ice.

According to an embodiment of the vessel, the opening through which the anchor line travels into the water is arranged—substantially—halfway between the midpoint of the vessel (i.e. the midpoint of the vessel in the longitudinal direction thereof, which is also designated the midship point) and the stern of the vessel.

Positioning of the opening in that place means that the vessel needs less fuel for maneuvering, while simultaneously a sufficiently straightening momentum is maintained between the opening and the natural pivot point of the vessel.

In this embodiment, the vessel may thus be moved across a surface area of the water without the ice influencing the anchor line and without the need for expending much energy for maintaining a course/orientation which is favorable for icebreaking.

In practice, the ice also changes direction, and it is difficult if not impossible for operators to know in advance which direction it will change to. Therefore, the vessel may be equipped to deploy two or more anchors. Thereby, the vessel may use to advantage the one or the other anchor line for icebreaking. Of course, according to such embodiment, the vessel may also use the pull from two or more anchor lines for icebreaking and, likewise, the anchor handling winches may—by suitable deployment of several anchors—be utilized as powering means for moving the vessel transversally to the direction of movement of the ice. Further, by locating the opening through which the anchor line travels outwards below sea level, the anchor line is not impacted by the ice, and hence the torquing on the vessel is avoided which might otherwise occur as a consequence of the ice impinging on the anchor line.

According to one embodiment of the invention, the vessel has two openings arranged below the water line, and both between the midship point of the vessel and the stern.

According to another embodiment of the invention, the vessel has two openings arranged below the water line and both between the midship point of the vessel and the bow.

According to another embodiment, an icebreaking supply vessel with one or two azimuth propellers is used, i.e. propellers that can be rotated 360° about an essentially vertical axis. Usually, the vessel has lateral propellers, but such drives play a minor part compared to the azimuth propellers, in particular when it is the heel that is made to face towards the ice. Thereby the azimuth propellers may, on the one hand, serve to grind the ice and, on the other, push the ice chunks away along with the propeller water.

When the heel is disposed against the ice, the anchor handling winch can be used to pull the vessel upwards against the movement of the ice to the effect that machine power is used only to grind the ice and to push the ice around the drilling vessel.

By using vessels according to the invention, a larger number of vessels can be anchored and operate quite closely to the drilling platform without an ensuring risk of them colliding. Thereby the water around the drilling vessel can be kept free of ice in a particularly efficient manner, and much money can be saved on ice-doublings of the drilling vessel.

By the phrase "expanse of the vessel" is intended the area comprised by the largest length of the vessel, and the largest width of the vessel. The largest length and the largest width of the vessel are also designated "LOA."

Turning now to the drawings, FIG. 1 shows an offshore installation, such as the drilling vessel 1 in Arctic waters. The offshore installation may also be a floating drilling platform, stationary platform, dynamic drilling station, or any other type of installation. The drilling vessel 1 is retained by means of eight anchors as shown. The associated anchor lines are illustrated by means of the eight arrows in the figure. FIG. 1 also shows a number of large ice floes 3 that are broken by means of icebreakers 20, 120, 220 to the effect that only relatively few and small chunks of ice 4 drift along and past the drilling vessel, since the ice drifts in the direction of the shown arrow P. If an ice floe the size of floes 3 hits the drilling vessel, the anchors thereof cannot uphold the requisite, exact position.

Icebreakers 20, 120, 220 are typically in mutual communication with one another to obtain the most efficient icebreaking possible. However, this does not prevent the energy consumption onboard the three vessels to be high, through use of high power through each vessel's motive power drives, such as heavy diesel engines. The present invention results in a considerable reduction in the consumption of resources necessary for breaking the ice sufficiently.

Figure 2:
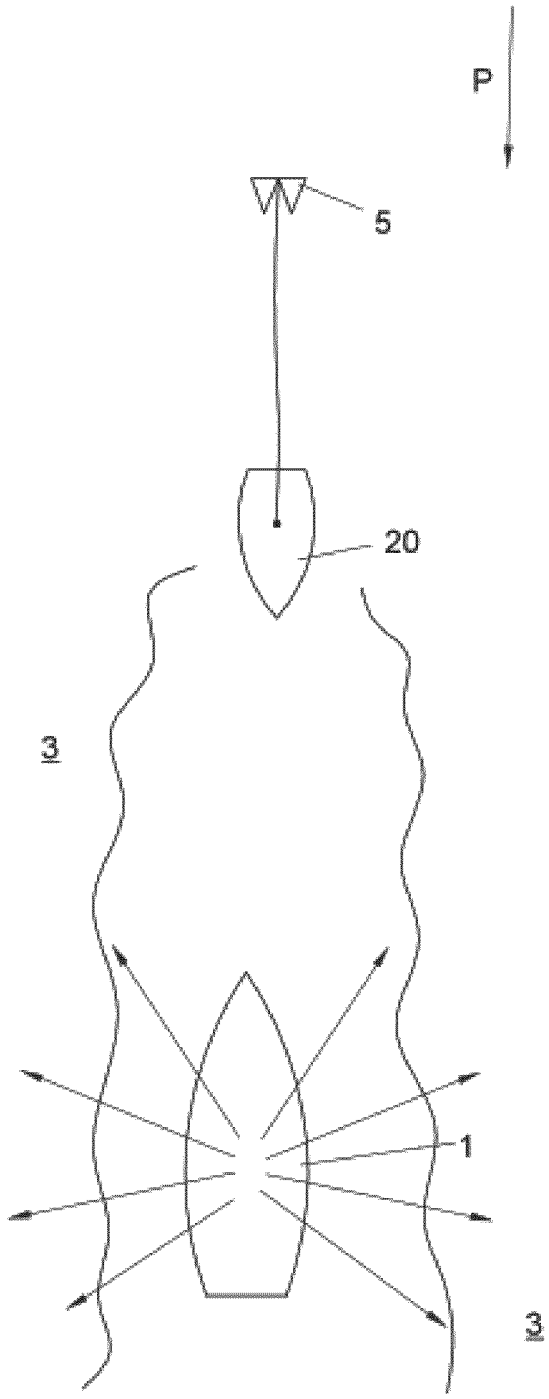
FIG. 2 shows an embodiment of a method for ice management in accordance with the invention.

FIG. 2 illustrates a method whereby a vessel 20, e.g. an ice-breaking supply vessel, sets an anchor 5 to the effect that the vessel 20 will drift in the direction of the drilling vessel 1 when the anchor line is deployed. The anchor line may typically have a length of 1000 m (depending on the depth of water, but typically it is three times the depth of water). The ice moves essentially in the direction of the arrow P from an upsea area toward a downsea area relative to the vessel, but for the sake of overview the ice is not shown in FIG. 2.

As vessel 20 operates without its active motive power drive and remains anchored in place, the ice which is moving towards the drilling vessel 1 is broken. It will appear from the figure that the vessel turns the heel towards the ice, and by means of a pair of fixed propellers, it is easy to turn the vessel relative to the direction of movement of the ice (see below) and to thereby use to advantage the pressure exerted by the ice to shift the vessel 20 transversally of the direction of movement of the ice. In certain conditions, one single vessel operating in this manner suffices for protecting the drilling vessel 1.

Figure 3:
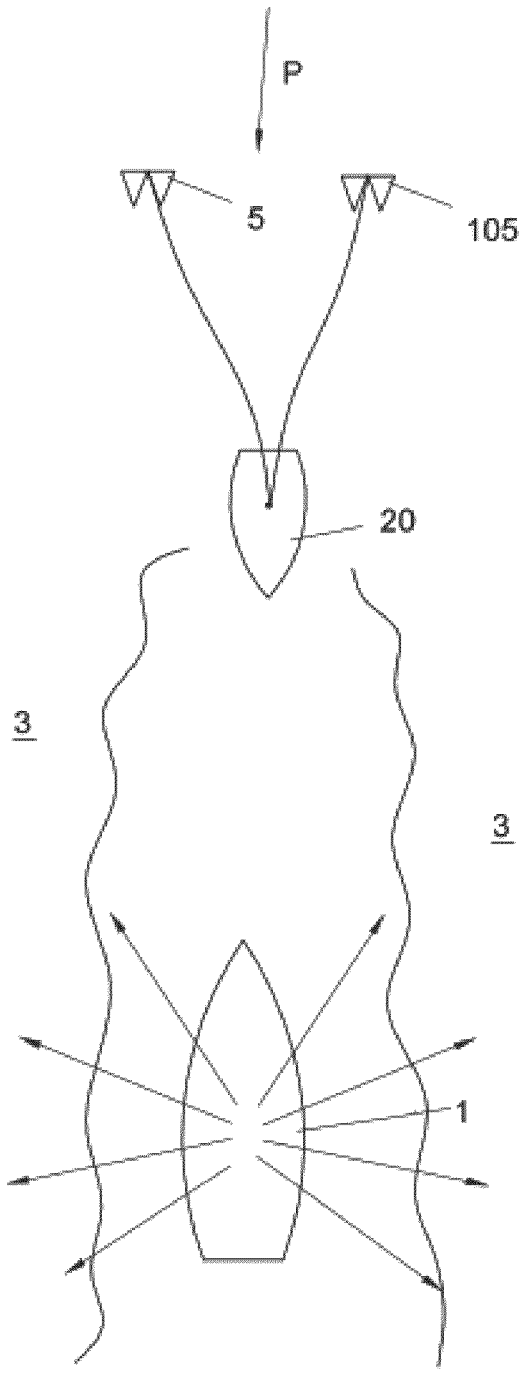
FIG. 3 shows an alternative embodiment of a method and configuration for icebreaking within a given area in accordance with the invention.

FIG. 3 shows an alternative or a supplementary method for shifting the vessel 20 in the transverse direction to the effect that a sufficiently wide belt is provided where the ice is rendered substantially harmless. This is done by deployment of two anchors 5, 105 and by utilizing the anchor handling winches of the respective anchor lines to balance the forces in and the lengths of the anchor lines to the effect that such measure contributes to controlling the position of the vessel. By simultaneous use of propellers, the vessel operator has many options for breaking the ice optimally.

According to another embodiment, one or more icebreaking supply vessels are used that are provided with an azimuth propeller at both sides in the stern of the vessel. Those propellers that can be rotated 360° are particularly efficient for use in the exercise of the method according to the invention. When the anchor line holds the vessel up against the pressure of the ice, the propellers can be set in a transverse position to the effect that they both press the one side of the vessel towards the ice, the propeller close to the ice crushing and grinding it, while the other disposes of the ice away from the vessel using its propeller water.

Figure 4:
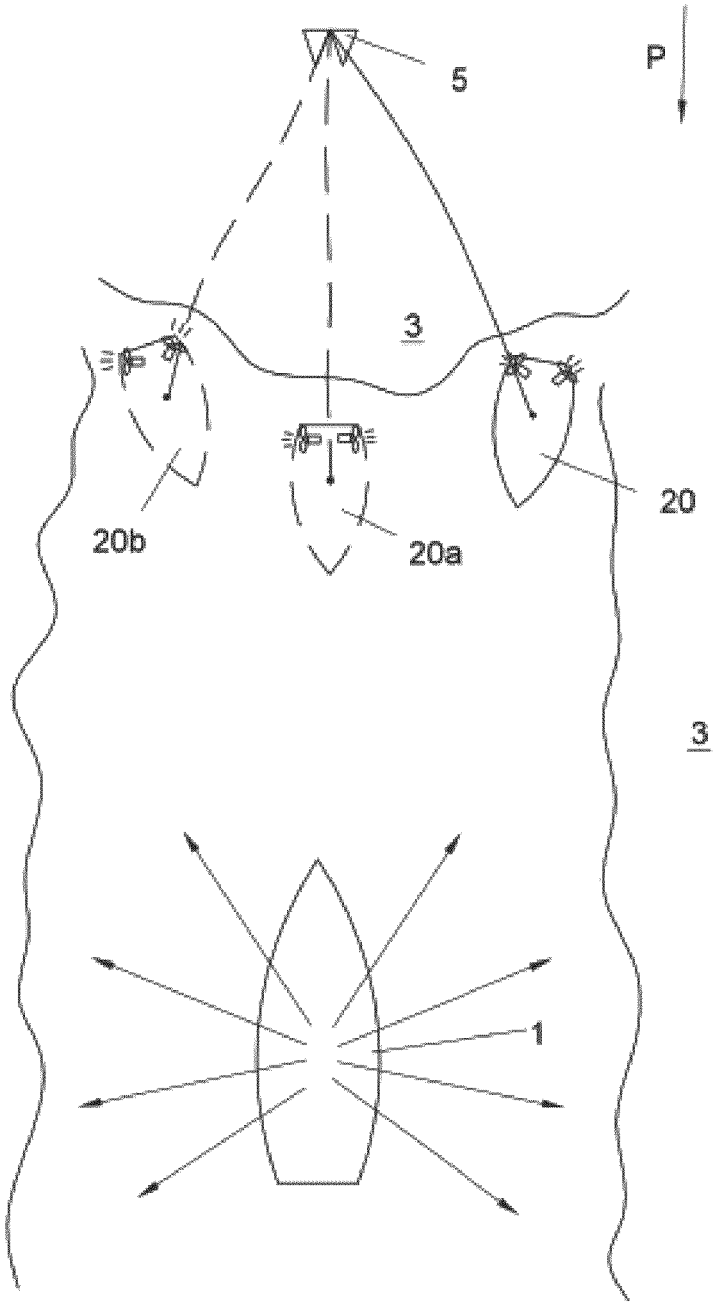
FIG. 4 shows yet another embodiment of a method and configuration in accordance with the invention.

FIG. 4 illustrates ice management by means of a method. The drilling vessel is still shown by 1, but now three icebreaking supply vessels 20, 20*a*, 20*b* are used that are anchored by means of anchor 5. The figure also shows large floes of ice 3. The small chunks of ice are not shown.

The middle vessel is retained by anchor 5 and grinds ice off the ice floe 3 which is pushed away by the propeller water. The outermost vessels 20 and 20*b* also machine the ice floe 3 simultaneously using their respective propellers, although not necessarily their main motive drive systems. Azimuth and side propellers such as those shown schematically may also be used to grind and chop ice, with the floe 3 being pushed to either side to create a zone substantially free of large ice floes around the drilling vessel 1. In this manner, the water around the drilling vessel can be kept free from ice to such degree that it is not necessary to ice-double the drilling vessel significantly. Thereby further economies can be obtained by the method according to the invention in addition to the great economies obtained on fuel and the ensuing reduction of pollution.

Of course, it is common that the direction of the current/the ice changes. It may therefore also be necessary to move anchors and vessels to continuously eliminate ice and/or render ice harmless around an offshore installation. In order to monitor the movement of the ice, it is an option to deploy, in an area around the offshore installation, one or more GPS apparatuses (loggers)—known per se—on the ice. Thus, by means of the GPS apparatuses, it is possible to monitor the movement of the ice around the offshore installation and to obtain a (an early) warning of substantial changes to the direction of movement of the ice. Thereby it is also possible to issue a warning about and to implement movement of anchors in due time to the effect that it is possible to continuously render the ice harmless (or to keep the sea completely free from ice) around the offshore installation.

Figure 5:
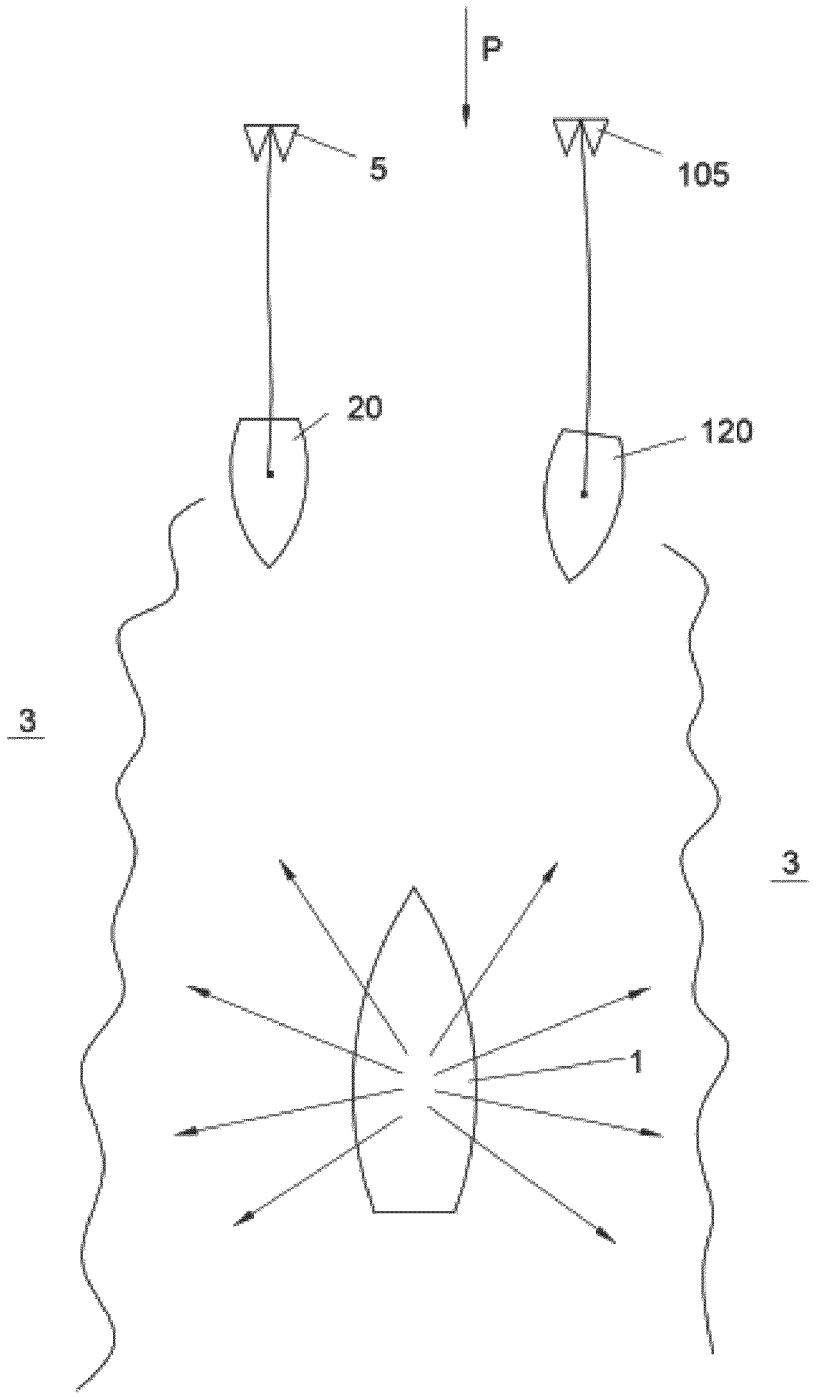
FIG. 5 shows another embodiment of a method and configuration in accordance with the invention.

FIG. 5 shows a further, alternative embodiment, wherein two supply vessels 20, 120 are used that are anchored by each their anchor 5 and 105, respectively. In this way, the width of the belt where the ice has been rendered harmless is widened, and it is noted that it is possible to situate the vessels 20 and 120 fairly close to the drilling vessel 1 without an ensuing risk of them colliding with each other as the very large forces in the direction of movement of the ice are absorbed by the respective anchor lines which are essentially parallel.

Figure 6:
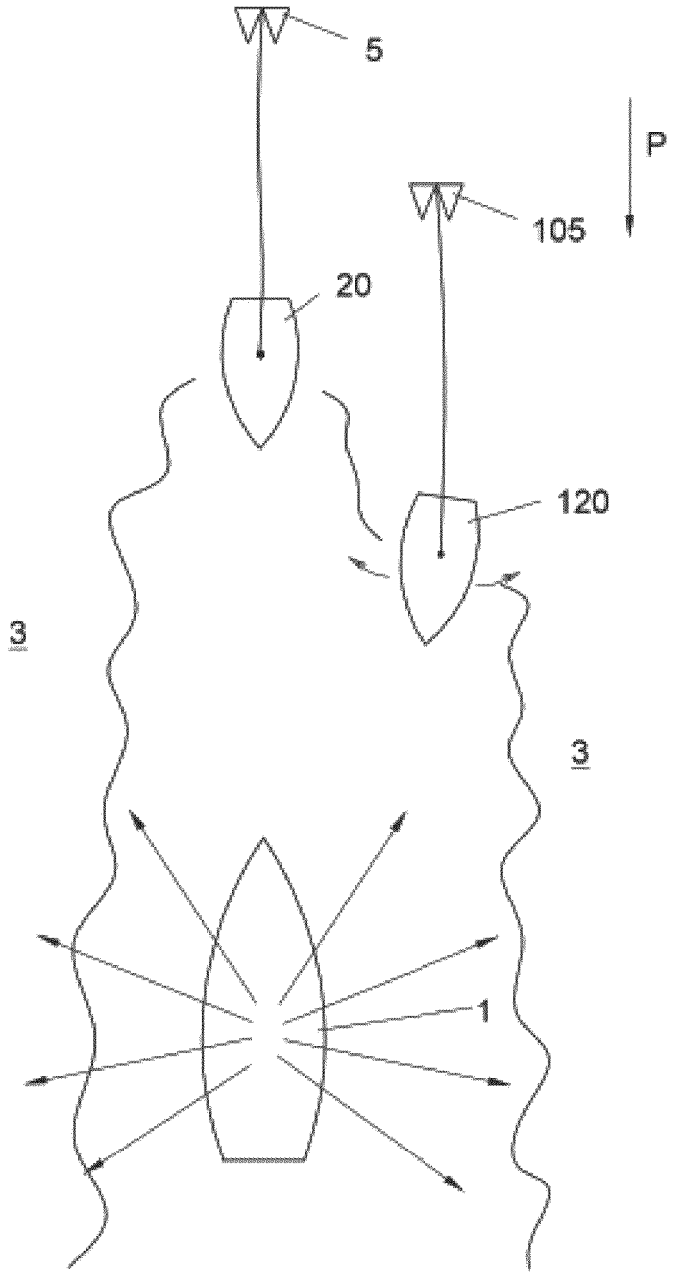
FIG. 6 shows another embodiment of a method and configuration in accordance with the invention.

FIG. 6 Illustrates ice management by means of a method in accordance with the present invention, wherein two vessels 20 and 120 are positioned to mutually advance in relation to the ice flow direction P. As with the previous embodiments, the vessels may be anchored to prevent substantial movement relative to the embedded anchor on the sea floor, while the advancing ice moves relative to the anchored vessels.

It may be appropriate to allow the one vessel 20 to be positioned in place using only its anchor 5 without the use of any supplemental power. In this way, the vessel 20 may break ice to create a safe belt running from the vessel 20 to the offshore platform 1 relatively free of large pieces of ice around the offshore platform 1 as illustrated.

The second vessel 120 is similarly anchored using its anchor 105 as shown, slightly offset from the line extending between the offshore platform 1 and the first vessel 20. This shifted position of the second vessel 120 allows it to perform a similar ice breaking function without the significant use of drive power from the vessel's main motive drive engines. This allows the creation of a larger belt or swath of down towards the offshore platform 1 in the direction of the flow P.

The first vessel 20 therefore serves both to break ice flowing in the flow direction P essentially down toward the offshore installation 1. However, because ice is stronger as a coherent, larger mass, the vessel 20 also weakens the ice pieces by breaking them down, which can extend down toward offshore installation. In an alternate embodiment, therefore, the other vessel 120 can be unanchored to further break the weakened ice for a surface area using a lower degree of motive drive power than would normally be required to break stable coherent ice. By positioning the vessels in these various configurations, economical and efficient icebreaking methods may be applied to individual sets of conditions.

Figure 7:
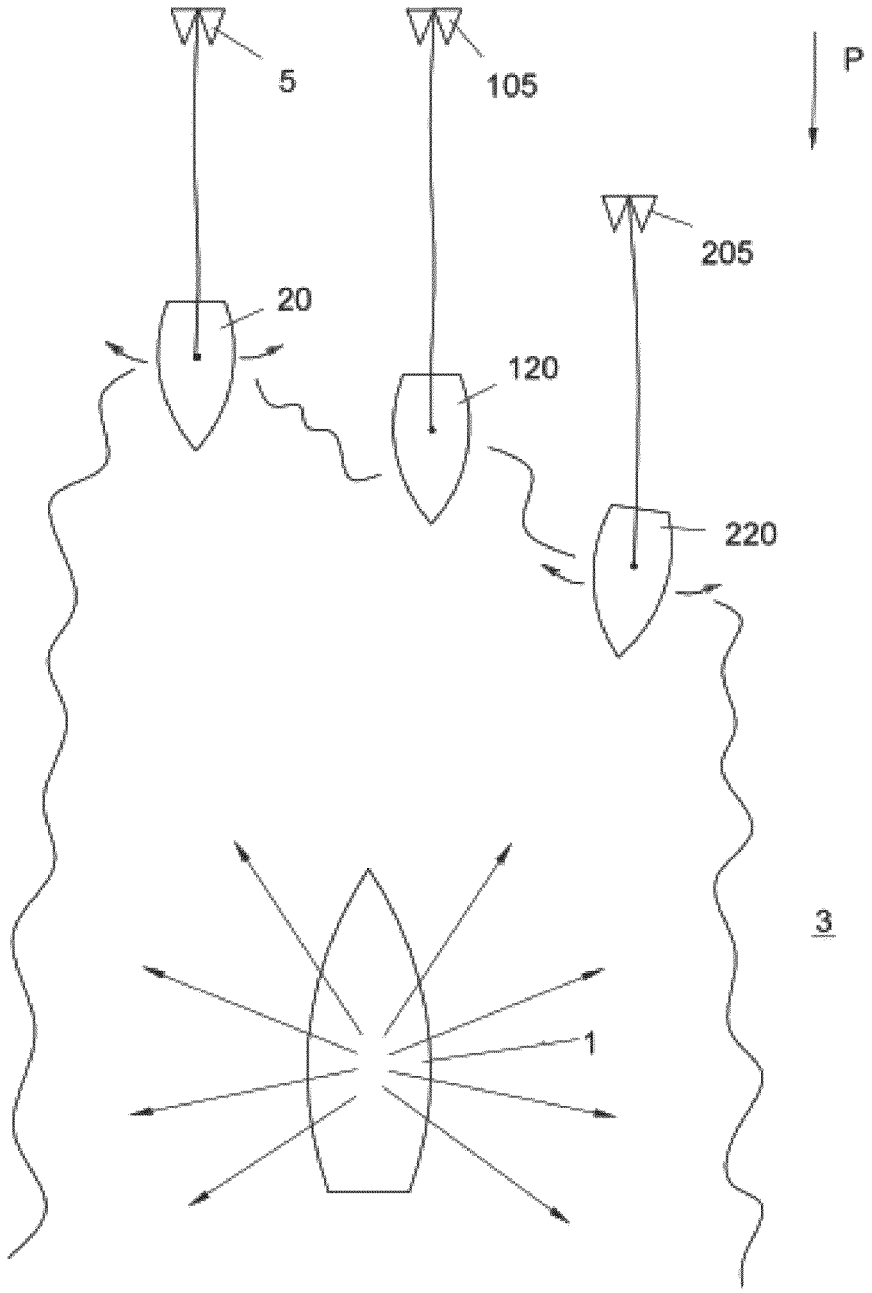
FIG. 7 shows a further embodiment of a method and configuration.

FIG. 7 shows another embodiment wherein three separate service vessels 20, 120 and 220, each anchored by their respective anchors 5, 105 and 205, respectively, are used to break ice in a wider area than the single vessel 20 could do alone. With such vessels in such configurations it may be unnecessary for all of the vessels to utilize azimuth propeller systems to more finely tune their positions relative to each other and the ice.

In the present configuration, the first vessel 20 is placed the greatest distance from the offshore installation, and positioned to the left in this aerial view. The cascading right edge of the belt formed in the ice, which is now partially broken up and therefore having less strength, can then be serviced more efficiently by the other vessels 120 and 220. By varying the distances between the vessels and the offshore installation 1, again more efficient icebreaking with a minimum use of propellers or engine power may be conducted.

Figure 8:
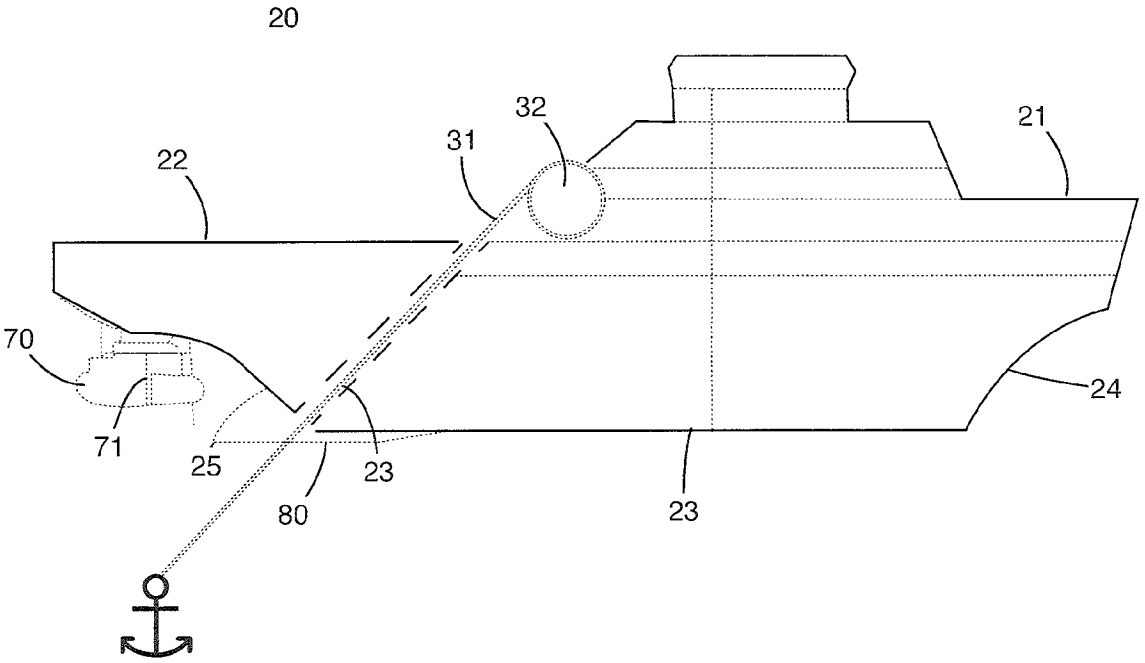
FIG. 8 shows a further embodiment of a vessel in accordance with the invention.

FIG. 8 is a schematic sectional view of an embodiment of a vessel according to the invention.

The vessel comprises a bow 21 and a stern 22, both of which are configured with an icebreaking portion 24 and 25, respectively. They are separated by and are situated above the most deeply situated part of the vessel which—in the embodiment shown, is the so-called flat bottom 23—in the horizontal plane. This lowest portion of the vessel's hull may comprise the keel or other bottom surface of the vessel, whether fully flat or not.

In the stern of the vessel, an internal passage 30 is shown which—in the embodiment shown—contains an anchor line 31. At the one end, the anchor line is wound around an anchor handling power winch/wheel 32 and, at the other end, it is attached to an anchor 33. According to one embodiment of the invention, the opening through which the anchor line passes out into the water is located as far towards the stern as possible in the flat bottom 23 of the vessel. In another embodiment of the invention, the opening may be positioned either midship along the bottom of the vessel or in proximity to the point around which the vessel will pivot naturally.

In another embodiment of the vessel of FIG. 8, the opening through which the anchor line passes into the water may be placed along or next to the keel of the vessel.

When the anchor 33 is firmly planted in the sea floor or attached to some other stable mooring device, the vessel 20 may be held stable in relation to the direction of movement or flow of the larger pieces of ice, or ice floes. The winch 32 may be used to stabilize the boat or allow it to move within a specified range of the anchor, allowing the boat to move relative to the anchor and reducing any additional thrust that might be needed by the vessel's main motive power system.

Also, as noted above, by holding the vessel 20 steady relative to the ice floe, the movement of the ice relative to the anchored vessel can break up the ice into smaller pieces in the same fashion as if the vessel were moving under its own power relative to the ice floe.

This text uses the term anchor handling power winch/wheel which is different from a conventional capstan in that it is usually designed for far greater forces than conventional capstans. Thus, an anchor handling winch may exert pulls of 600-1000 tons (corresponding to about 6,000,000-10.000,000 Newton) and have a braking power of 1,000-1,500 tons (corresponding to about 10,000,000-15,000,000 Newton).

The vessel comprises one or more thruster(s) 70 arranged in the stern of the vessel 22. In the embodiment shown, the thruster 70 is journalled rotatably about an axis 71. Of course, vessel and thruster(s) may also be made such that one or more thruster(s) is (are) not rotatable.

For the sake of stability as well as performance, the thrusters of the vessel are arranged such that the propellers are located above the horizontal plane of the flat bottom, or the bottom-most part of the vessel. It is realized by the invention that an anchor line can be conveyed out through that part of the bottom which is below the vessel's propellers or thrusters, or the portion of any propeller shaft that extends from the hull, without the anchor line thereby coming into contact with these drive structures.

Figure 9:
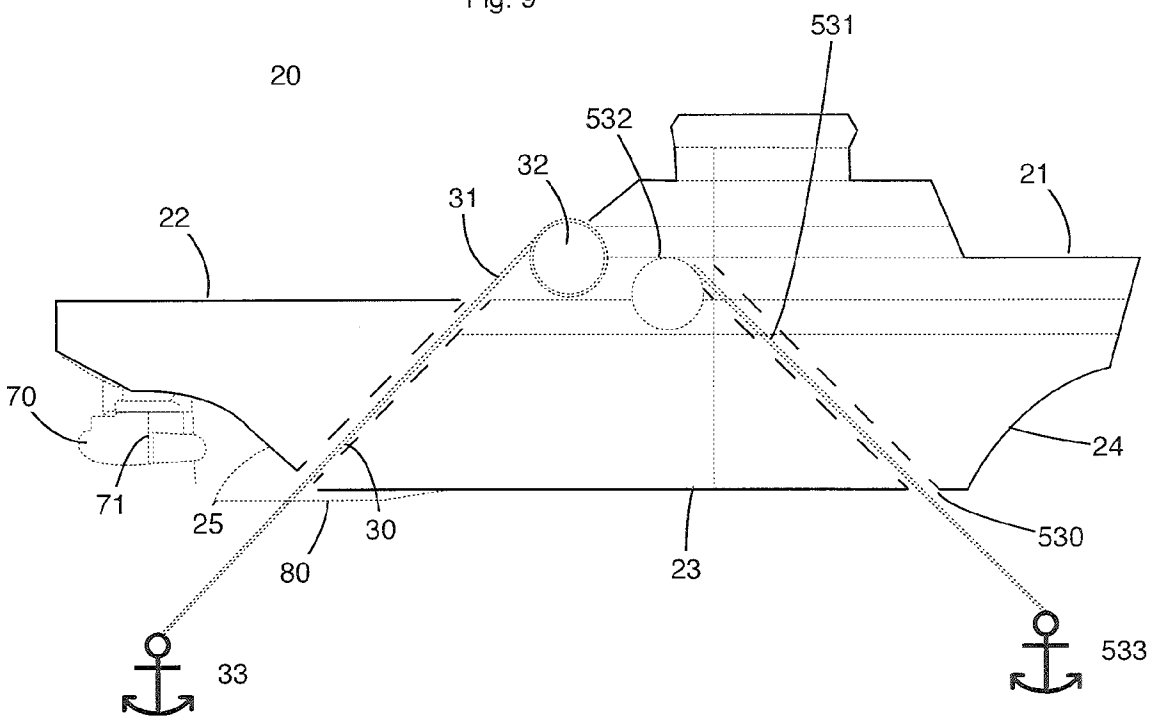
FIG. 9 shows the vessel of FIG. 8 modified to a further embodiment.

To increase the performance of the stern propellers of an icebreaking vessel, they are, in a corresponding manner (as shown in FIG. 9), sometimes arranged such that a part of the propellers or their blades go deeper into the water than the flat bottom 23 of the vessel. Such vessels are often made with a lowered bottom part called the "skeg." The skeg is situated in front (seen relative to the normal direction of sailing of the vessel). The purpose of a skeg is to protect the propellers in shallow waters since the skeg will prevent the propellers from hitting the bottom in case of a grounding, if any.

An actual icebreaking vessel can thus be made with "skeg" as shown in dotted line partially as item 80 FIG. 8, and in such vessels the invention can be executed by allowing the anchor line to pass into the water from a point in the skeg that is situated below (deeper than) the vessel's propellers (thrusters).

It is thus also possible to configure the skeg with a passage for anchor line, wherein the opening conveying the anchor line into the water is arranged in the skeg, and, more specifically, also to the rear thereof (towards the stern). Also with the modifications that are within the ordinary skills of the person skilled in the art.

FIG. 9 shows another embodiment of the vessel 20 shown in FIG. 8. In this embodiment, a second passage 530 may be placed between a midship point 500 of the vessel and the bow 24. The second passage 530, like the opening for the passage 30, opens below the waterline of the vessel 20 and on the flat bottom portion of the vessel deeper than the level of the thrusters (or propellers) 70. Through this second passage 530, a second anchor line 531, connected at one end to a winch 532, may pass through. The second anchor line is connected in turn to a second anchor 533. Through the use of this second anchoring system, the vessel 20 can be more precisely oriented and controlled using both anchor winches to move the vessel forward and backward, and turned, relative to the ice. These winches may be used in place of or supplemental to any thrusters. Of course, additional anchor lines may be added to the vessel, either extending out the bottom of the hull or in different areas.

Figure 10:
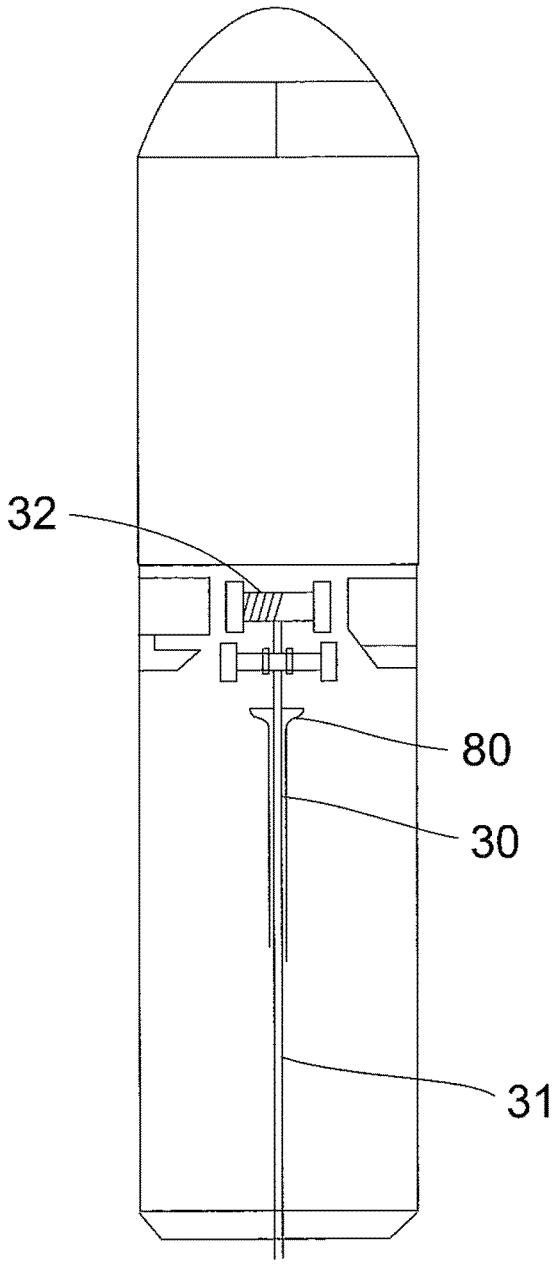
FIG. 10 shows a vessel as shown in FIG. 8, seen from above.

FIG. 10 shows a vessel as shown in FIG. 8, seen from above. Centrally of the vessel, an anchor handling winch 32 is shown which is coupled to an anchor (not shown) via an anchor line 31 extending via an internal passage (outlined behind the funnel 80) and further out through an opening (not shown in this view) in the bottom of the vessel.

As will appear from FIG. 10, the anchor line extends from the anchor handling winch into a funnel-like part 80. The purpose of that part 80 is to convey the anchor line from the winch and into the internal passage (shown in dotted lines) which extends through the vessel and out through the bottom thereof. The shape of the funnel-like part may of course be varied within the ordinary skills of the person skilled in this art; the essential aspect being that the funnel-like part is capable of capturing the anchor line from the entire width of the anchor handling winch and of conveying it into the internal passage of the vessel.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. An icebreaking vessel for use in proximity to an offshore installation in an area containing drifting ice, said vessel comprising:

a hull having at least one hull portion;

motive power means for moving the vessel while it is anchored, said motive power means including at least one propeller shaft;

said at least one hull portion on said hull having a lower wall being positioned deeper than said at least one propeller shaft, wherein said lower wall of said at least one hull portion defines a flat bottom on said hull;

a substantially straight internal passage that extends from an underwater opening defined in the lower wall of the hull, between a mid section of the vessel and one of a bow and a stern of the vessel, to an opening in a top deck of the vessel adjacent to a winch, wherein the bow and stern are configured with an icebreaking portion; and an anchor connected to said vessel via an anchor line, said anchor line extending through said substantially straight internal passage to the winch;

wherein said hull is a monohull and said vessel is capable of performing icebreaking tasks while anchored.

2. The icebreaking vessel of claim 1, wherein said at least one underwater opening is positioned below the water line of said vessel.

3. The icebreaking vessel of claim 2, further comprising a second substantially straight internal passage that extends from a second underwater opening defined in the lower wall of the hull, between the mid section of the vessel and the other of the one of the bow and the stern of the vessel, to a second opening adjacent to a second winch.

4. The icebreaking vessel of claim 3, further comprising a second anchor connected to said vessel via a second anchor line extending through said second substantially straight internal passage to the second winch.

5. The icebreaking vessel of claim 1, wherein the winch is a power winch configured to wind the anchor line.

6. The icebreaking vessel of claim 4, wherein the area of water has a significantly larger expanse than the expanse of the vessel, and wherein said vessel is movable across a surface area of the water via at least one of said motive power means and said power winch.

7. The icebreaking vessel of claim 1, wherein said lower wall of said at least one hull portion further comprises a portion of a skeg.

8. An icebreaking vessel for breaking large pieces of ice in a surface area of water in proximity of an offshore installation, said vessel comprising:

a hull having at least one propeller, said hull including a substantially straight internal passage that extends from an underwater opening defined in a lower wall of the hull, wherein said lower wall further defines a flat bottom on said hull, between a mid section of the vessel and one of a bow and a stern of the vessel, to an opening in a top deck of the vessel adjacent to a winch, wherein said flat bottom is positioned deeper than said at least one propeller and wherein the bow and stern are configured with an icebreaking portion;

an anchor deployable in an anchor line at a distance from the vessel, wherein the winch is configured to wind or unwind the anchor line through the internal passage; and motive power means for moving the vessel while it is anchored;

wherein said hull is a monohull and said vessel is capable of performing icebreaking tasks while it is anchored, and said vessel is movable across a surface area of the water which has a significantly larger expanse than the expanse of the vessel by means of the motive power means or the anchor handling winch.

9. The icebreaking vessel of claim 8, further comprising a second substantially straight internal passage that extends from a second underwater opening defined in the lower wall of the hull, between the mid section of the vessel and the other of the one of the bow and the stern of the vessel, to a second opening adjacent to a second winch, wherein the respective openings defined in the lower wall of the hull are arranged at a depth deeper than a propeller shaft of the vessel.

10. The icebreaking vessel of claim 9, wherein said underwater opening in the lower wall of the hull is arranged between the midship point of the vessel and the bow of the vessel, and said second opening in the lower wall of the hull is arranged between the midship point of the vessel and the stern of the vessel.

11. A vessel according to claim 9, wherein the second underwater opening in the lower wall of the hull is arranged approximately halfway between the middle of the vessel and the stern of the vessel substantially along a centerline of the vessel running from bow to stern.

12. A vessel according to claim 9, wherein the second underwater opening in the lower wall of the hull is arranged in the skeg of said vessel.

13. A vessel according to claim 9, wherein the second underwater opening in the lower wall of the hull is arranged between the midship point of the vessel and the stern.

14. An icebreaking vessel for use in proximity to an offshore installation in an area containing drifting ice, said vessel comprising:

a hull having at least one hull portion;

a hull extending at least partially under water and having a water line; at least one propeller extending out of said hull under the water line;

said at least one hull portion having a lower wall being positioned deeper than said at least one propeller, wherein said lower wall of said at least one hull portion defines a flat bottom on said hull;

a substantially straight internal passage that extends from an underwater opening defined in the lower wall of the at least one hull portion, between a mid section of the vessel and one of a bow and a stern of the vessel, to an opening in a top deck of the vessel adjacent to a winch, wherein the bow and stern are configured with an icebreaking portion; and an anchor connected to said vessel via an anchor line, said anchor line extending through said a substantially straight internal passage;

wherein said hull is a monohull and said vessel is capable of performing icebreaking tasks while anchored.

15. The icebreaking vessel of claim 14, wherein said at least one underwater opening in the lower wall of the at least one hull portion is positioned below the water line of said vessel.

16. The icebreaking vessel of claim 14, further comprising a motive drive in communication with said at least one propeller to drive said propeller.

17. The icebreaking vessel of claim 16, further comprising a positioning drive to assist in orienting said vessel relative to said anchor.

18. The icebreaking vessel of claim 14, wherein the winch is configured to wind said anchor line and thereby position said vessel relative to said anchor when said anchor is planted in the sea floor.

19. A vessel having an icebreaking hull to break ice in a surface area of water in proximity of an offshore installation, said vessel comprising:

a hull having at least one propeller, said hull including a substantially straight internal passage that extends from an underwater opening defined in a lower wall of the hull, between a mid section of the vessel and one of a bow and a stern of the vessel, to an opening in a top deck of the vessel adjacent to a winch, wherein said lower wall defines a flat bottom on said hull, wherein the bow and wherein said lower wall is positioned deeper than said at least one propeller and stern are configured with an icebreaking portion;

an anchor deployable in an anchor line at a distance from the vessel, wherein the winch is configured to wind or unwind an anchor line through the substantially straight internal passage; and motive power means for moving the vessel while it is anchored;

wherein said hull is a monohull and said vessel is capable of performing icebreaking tasks while it is anchored and said vessel being movable across a surface area of the water which has a significantly larger expanse than the expanse of the vessel.

20. The vessel of claim 19, wherein said opening defined in the lower wall of the hull is positioned below a propeller shaft of the vessel.

21. The vessel of claim 20, wherein the opening defined in the lower wall of the hull is arranged in proximity of the point around which the vessel will pivot naturally.

22. The vessel of 20, wherein said opening defined in the lower wall of the hull is arranged as far towards the stern in the bottom of the vessel as possible without the opening rising higher than the level of the horizontal plane of the vessel bottom.

23. The vessel of claim 19, wherein the opening defined in the lower wall of the hull is arranged as far towards the stern in the vessel as possible without the opening rising higher than the level of the lowermost part of the propeller periphery.

24. The vessel of claim 19, wherein the opening defined in the lower wall of the hull is positioned in the skeg of the vessel.

25. The vessel of claim 19, wherein the opening defined in the lower wall of the hull is positioned substantially halfway between the midship point of the vessel and the stern of the vessel.

26. The vessel of claim 19, wherein the opening defined in the lower wall of the hull is positioned substantially halfway between the midship point of the vessel and the bow of the vessel.

27. The vessel of claim 19, further comprising a second substantially straight internal passage that extends from a second underwater opening defined in a lower wall of the hull, between a mid section of the vessel and the other of the bow and the stern of the vessel, to an opening adjacent to a second winch, wherein said first and second openings defined in the lower wall of the hull are arranged below the water line of the vessel.

* * * * *

UNITED STATES PATENT AND TRADEMARK OFFICE

CERTIFICATE OF CORRECTION

PATENT NO. : 9,056,658 B2
APPLICATION NO. : 13/077772
DATED : June 16, 2015
INVENTOR(S) : Niels Peter Elmbo It is certified that error appears in the above-identified patent and that said Letters Patent is hereby corrected as shown below:

On the Title Page

Left column, insert item (30), as follows:
--Foreign Application Priority Data
March 31, 2010 (DK) PA201070136
October 29, 2010 (DK) PA201070465
March 31, 2011 (DK) PA201170154--.

In the Claims

In column 10, claim 19, lines 36-37, after "on said hull," delete "wherein the bow and".

In column 10, claim 19, line 38, after "propeller and" insert --wherein the bow and--.

Signed and Sealed this
Twenty-third Day of February, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,056,658 B2
APPLICATION NO. : 13/077772
DATED : June 16, 2015
INVENTOR(S) : Elmbo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 294 days.

Signed and Sealed this
Fourteenth Day of June, 2016

Michelle K. Lee

Michelle K. Lee
*Director of the United States Patent and Trademark Office*